US007319769B2

(12) United States Patent
Allegro-Baumann et al.

(10) Patent No.: US 7,319,769 B2
(45) Date of Patent: Jan. 15, 2008

(54) METHOD TO ADJUST PARAMETERS OF A TRANSFER FUNCTION OF A HEARING DEVICE AS WELL AS HEARING DEVICE

(75) Inventors: Silvia Allegro-Baumann, Unterageri (CH); Nail Cadalli, Champaign, IL (US); Stefan Launer, Zurich (CH); Valentin Chapero-Rueda, Wollerau (CH)

(73) Assignee: Phonak AG, Stafa (CH)

( * ) Notice: Subject to any disclaimer, the term of this patent is extended or adjusted under 35 U.S.C. 154(b) by 318 days.

(21) Appl. No.: 11/008,440

(22) Filed: Dec. 9, 2004

(65) Prior Publication Data

US 2006/0126872 A1 Jun. 15, 2006

(51) Int. Cl.
*H04R 25/00* (2006.01)

(52) U.S. Cl. ..... 381/312; 381/314

(58) Field of Classification Search ..... 381/91, 381/92, 312, 314, 315, 320, 321, 323, 23.1, 381/310; 704/200.1, 255, 256, 256.1, 271
See application file for complete search history.

(56) References Cited

U.S. PATENT DOCUMENTS 5,604,812 A * 2/1997 Meyer ..... 381/314
6,895,098 B2 * 5/2005 Allegro et al. ..... 381/312
6,910,013 B2 * 6/2005 Allegro et al. ..... 704/256

* cited by examiner

*Primary Examiner*—Huyen Le
(74) *Attorney, Agent, or Firm*—Pearne & Gordon LLP

(57) ABSTRACT

A method to adjust parameters of a transfer function of a hearing device is disclosed, the method comprising the steps of extracting features of an input signal fed to the hearing device, classifying the extracted features into one of several possible classes, selecting a class corresponding to a best estimate of a momentary acoustic scene, adjusting at least some of the parameters of the transfer function in accordance with the selected class representing the best estimated momentary acoustic scene, and training the hearing device to improve classification of the extracted feature or the best estimate of the momentary acoustic scene, respectively, during regular operation of the hearing device. As a result, the hearing device does not only improve its behavior when new data is presented lying outside of known training data, but the hearing device is also better and faster adapted to most common acoustic scenes, with which the hearing device user is confronted.

26 Claims, 3 Drawing Sheets

METHOD TO ADJUST PARAMETERS OF A TRANSFER FUNCTION OF A HEARING DEVICE AS WELL AS HEARING DEVICE

TECHNICAL FIELD OF THE INVENTION

The present invention is related to methods to adjust parameters of a transfer function of a hearing device as well as to a hearing device.

BACKGROUND OF THE INVENTION

Automatic classification of acoustic environment (or acoustic scene) is an essential part of an intelligent hearing device. In the hearing device, the acoustic scene is identified using features of the sound signals collected from that particular acoustic scene. Therewith, parameters and algorithms defining the input/output behavior of the hearing device are adjusted accordingly to maximize the hearing performance. A number of methods of acoustic classification for hearing devices have been described in US-2002/0 037 087 A1 or US-2002/0 090 098 A1. The fundamental method used in scene classification is the so-called pattern recognition (or classification), which range from simple rule-based clustering algorithms to neural networks, and to sophisticated statistical tools such as hidden Markov models (HMM). Further information regarding these known techniques can be found in one of the following publications, for example:

- X. Huang, A. Acero, and H.-W. Hon, "Spoken Language Processing: A Guide to Theory", Algorithm and System Development, Upper Saddle River, N.J.: Prentice Hall Inc., 2001.
- L. R. Rabiner and B.-H. Juang, "Fundamentals of Speech Recognition", Upper Saddle River, N.J.: Prentice Hall Inc., 1993.
- M. C. Buchler, Algorithms for Sound Classification in Hearing Instruments, doctoral dissertation, ETH-Zurich, 2002.
- L. R. Rabiner and B.-H. Juang, "An introduction to Hidden Markov Models", IEEE Acoustics Speech and Signal Processing Magazine, January 1986.
- S. Theodoridis and K. Koutroumbas, "Pattern Recognition", New York: Academic Press, 1999.

Pattern recognition methods are useful in automating the acoustic scene classification task. However, all pattern recognition methods rely on some form of prior association of labeled acoustic scenes and resulting feature vectors extracted from the audio signals belonging to these acoustic scenes. For instance in a rule-based clustering algorithm, it is necessary to set proper thresholds for feature comparisons to differentiate one acoustic scene from other acoustic scenes. These thresholds on feature values are obtained observing a set of audio signals for their characteristics associated with certain acoustic scenes. Another example is an HMM—(Hidden Markov Model) classifier: one adjusts the parameters of a HMM for each acoustic scene one would like to recognize using a set of training data. Then in the actual processing stage, each HMM structure processes the observation sequence and produces a probability score indicating the probability of the respective acoustic scene. The process of associating observations with labeled acoustic scenes is called training of the classifier. Once the classifier has been trained using a training data set (training audio), it can process signals that might be outside the training set.

The success of the classifier depends on how well the training data can represent arbitrary data outside the training data.

An objective of the present invention is to provide a method that has an improved reliability when classifying or estimating a momentary acoustic scene.

SUMMARY OF THE INVENTION

A method to adjust parameters of a transfer function of a hearing device is disclosed, the method comprising the steps of extracting features of an input signal fed to the hearing device, classifying the extracted features into one of several possible classes, selecting a class corresponding to a best estimate of a momentary acoustic scene, adjusting at least some of the parameters of the transfer function in accordance with the selected class representing the best estimated momentary acoustic scene, and training the hearing device to improve classification of the extracted feature or the best estimate of the momentary acoustic scene, respectively, during regular operation of the hearing device.

Alternatively, a method to adjust parameters of a transfer function of a hearing device is disclosed, the method comprising the steps of extracting features of an input signal fed to the hearing device, classifying the extracted features into one of several possible classes, selecting a class corresponding to a best estimate of a momentary acoustic scene, adjusting at least some of the parameters of the transfer function in accordance with the selected class representing the best estimated momentary acoustic scene, surveying a control input to the hearing device, activating a training phase as soon as the control input is being activated, training the hearing device during a training phase by improving the best estimate of the momentary acoustic scene, whereas the hearing device is regularly operated during the training phase.

Furthermore, a hearing device is disclosed, comprising at least one microphone to generate at least one input signal a main processing unit to which the at least one input signal is fed, a receiver operationally connected to the main processing unit, means for extracting features of the at least one input signal, means for classifying the extracted features into one of several possible classes, means for selecting a class corresponding to a best estimate of a momentary acoustic scene, means for adjusting at least some of the parameters of a transfer function between the at least one microphone and the receiver in accordance with the best estimated momentary acoustic scene, and training means to improve the best estimate of the momentary acoustic scene during regular operation.

Alternatively to the above-described, a hearing device is disclosed, comprising at least one microphone to generate at least one input signal a main processing unit to which the at least one input signal is fed, a receiver operationally connected to the main processing unit, means for extracting features of the at least one input signal, means for classifying the extracted features into one of several possible classes, means for selecting a class corresponding to a best estimate of a momentary acoustic scene, means for adjusting at least some of the parameters of a transfer function between the at least one microphone and the receiver in accordance with the best estimated momentary acoustic scene, means for surveying a control input, means for activating a training phase as soon as the control input is being activated, training means for training the hearing device during a training phase by improving the best estimate of the momentary acoustic scene, whereas the main processing unit and the training means are operated simultaneously.

The present invention has one or several of the following advantages: By training the hearing device to improve the best estimate of the momentary acoustic scene during regular operation of the hearing device, a significant and increasing amount of data is presented to the hearing device. As a result, the hearing device does not only improve its behavior when new data is presented lying outside of known training data, but the hearing device is also better and faster adapted to most common acoustic scenes, with which the hearing device user is confronted. In other words, the acoustic scenes which are most often present for a particular hearing device user will be classified rather quickly with a high probability that the result is correct. Thereby, an initial training data set (as used in state of the art training) can be rather small since the operation and robustness of the classifier in the hearing device will be improved in the course of time.

BRIEF DESCRIPTION OF THE DRAWINGS

The present invention will be further described by referring to drawings showing exemplified embodiments of the present invention. It is shown in.

DETAILED DESCRIPTION OF THE INVENTION

Figure 1:
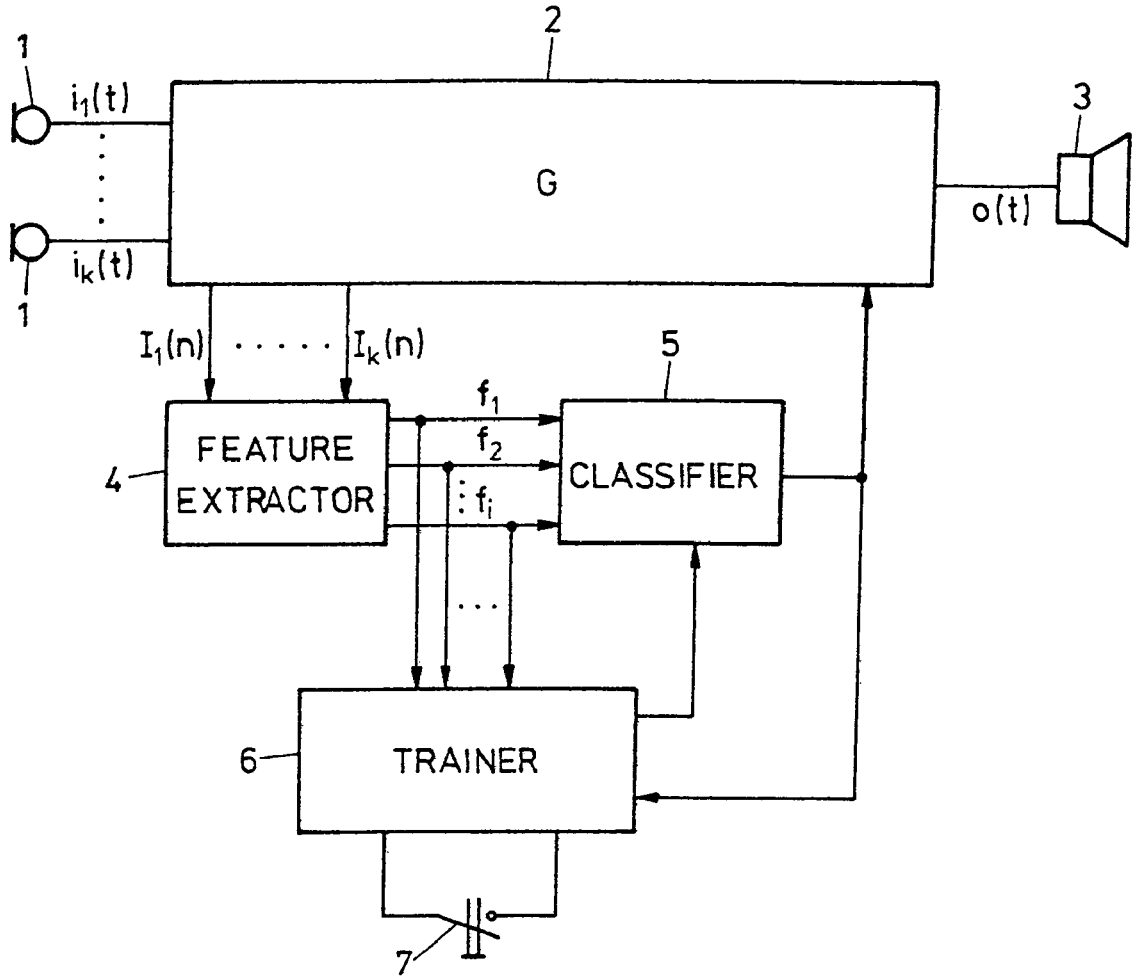
FIG. 1, schematically, a block diagram of a hearing device according to the present invention.

FIG. 1 schematically shows a block diagram of a hearing device according to the present invention. The hearing device comprises one or several microphones 1, a main processing unit 2 having a transfer function G, a loud speaker 3 (also called receiver), a feature extraction unit 4, a classifier unit 5, a trainer unit 6 and a switch unit 7. The microphones 1 convert an acoustic signal into electrical signals $i_1(t)$ to $i_k(t)$, which are fed to the main processing unit 2, in which the input/output behavior of the hearing device is defined and which generates the output signal o(t) that is fed to the receiver 3.

In order to extract certain features from the input signals $i_1(t)$ to $i_k(t)$—or in case of a digital hearing device $I_1(n)$ to $I_k(n)$—, the main processing unit 2 is operationally connected to the feature extraction unit 4, in which the features $f_1$, $f_2$ to $f_i$ are generated that are fed to the classifier unit 5 as well as to the trainer unit 6. The features $f_1$, $f_2$ to $f_i$ are classified in the classifier unit 5 in order to estimate the momentary acoustic scene, which is used to adjust the transfer function G in the main processing unit 2. Therefore, the classifier unit 5 is operationally connected to the main processing unit 2. According to the present invention, the trainer unit 6 is used to improve the estimation of the momentary acoustic scene and is therefore also operationally connected to the classifier unit 5. The operation of the trainer unit 6 is further described below.

It is expressly pointed out that all of the blocks shown in the block diagram of FIG. 1 can be readily implemented in a single processing unit, such as a digital signal processor (DSP), or each block can be implemented in a separate processing unit, respectively. The used functional delimitation, as shown in FIG. 1, is only for illustration purposes and shall not be used to limit the scope of the present invention.

Even though this invention applies to all classifiers in general, and, respectively, to all pattern recognition methods, the present invention is further explained by using a rule-based classifier or a HMM (Hidden Markov Model), respectively, which represent more or less the two ends of the spectrum of pattern recognition algorithms in the scale of complexity.

The Hidden Markov Model (HMM) is a statistical method for characterizing time-varying data sequences as a parametric random process. It involves dynamic programming principle for modeling the time evolution of a data sequence (the so-called context dependence), and hence is suitable for pattern segmentation and classification. The HMM has become a useful tool for modeling speech signals because of its pattern classification ability in the areas of speech recognition, speech enhancement, statistical language modeling, and spoken language understanding among others. Further information regarding these techniques can be obtained from one of the above referenced publications.

Acoustic scene classification is usually performed in two main steps: The first step is the extraction of feature vectors (or, simply features) from the acoustical signals such that the characteristics of the signals can be represented in a lower dimensional form. There are various features that can be extracted from audio signals including amplitude and spectral characteristics, spatial characteristics (location of sound sources, number of sound sources), onset/offset, pitch, coherence, level of reverberation, etc. These features are either monaural or binaural in a binaural hearing device (for a multi-aural hearing system, it is also possible to have multi-aural features).

In the second step, a pattern recognition algorithm identifies the class that a given feature vector belongs to, or the class that is the closest match for the feature vector.

The class that has the highest probability is the best estimate of a momentary acoustic scene. Therefore, the transfer function G of the main processing unit 2, i.e. the transfer function of the hearing device, is adjusted in order to be best suited for the detected momentary acoustic scene.

The present invention proposes to incorporate an on-the-fly training, i.e. during regular operation, of the classifier in order to improve its capability to classify the extracted features, therewith improving the selection of the most appropriate hearing program or transfer function G, respectively, of the hearing device.

In the following, several examples for the method of the present invention are described. It is pointed out that the different examples may be arbitrarily combined and that the skilled artisan may develop further embodiment without departing the concept of the present invention.

EXAMPLE 1

The first method of training involves the hearing device user. As the acoustic scene changes, the hearing device user sets the hearing device to training mode after setting the parameters of the hearing device such that the hearing performance is optimised. As far as the hearing device user keeps the training mode on, the hearing device trains its classifier unit 5 for the particular acoustic scene and records the settings of the hearing device for this particular acoustic scene as operational parameters.

If the acoustic scene permits, unattended training is also possible: after setting the parameters, the hearing device user takes off the hearing device and places it in the acoustic scene (e.g. in front of a CD—(compact disc) player for music training), which might provide hours of training.

Figure 2:
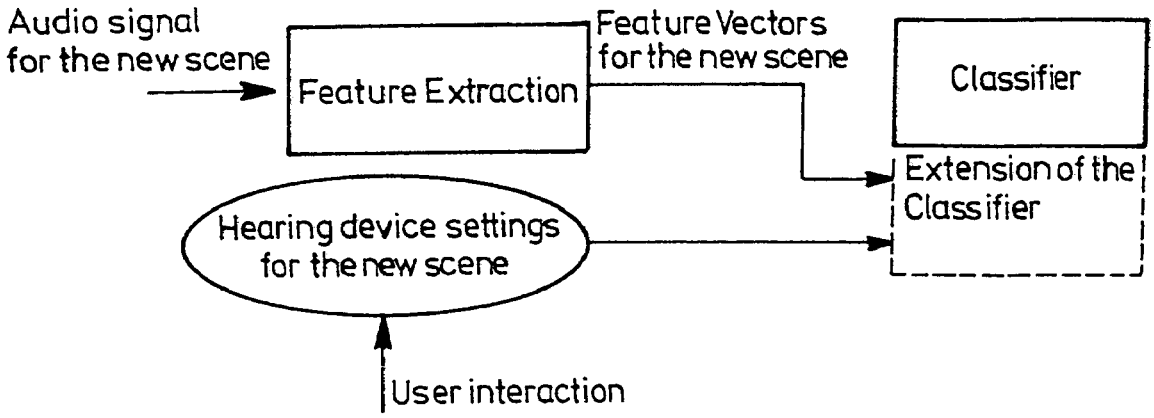
FIG. 2 a flow chart schematically illustrating basic steps of a first embodiment of a method according to the present invention.

This first method is depicted in FIG. 2 schematically illustrating basic steps in a flow chart. Feature vectors are extracted from the training audio signal and the classifier is trained using these features. Since the acoustic scene is a new acoustic scene to the classifier, the previously trained part of the classifier remains intact, while the newly trained part becomes an extension to the existing classifier structure, i.e. a new class is being trained. As has been pointed out the hearing device user is initiating and terminating the training mode after setting the parameters of the hearing device such that the hearing device performance is optimized.

Figure 3:
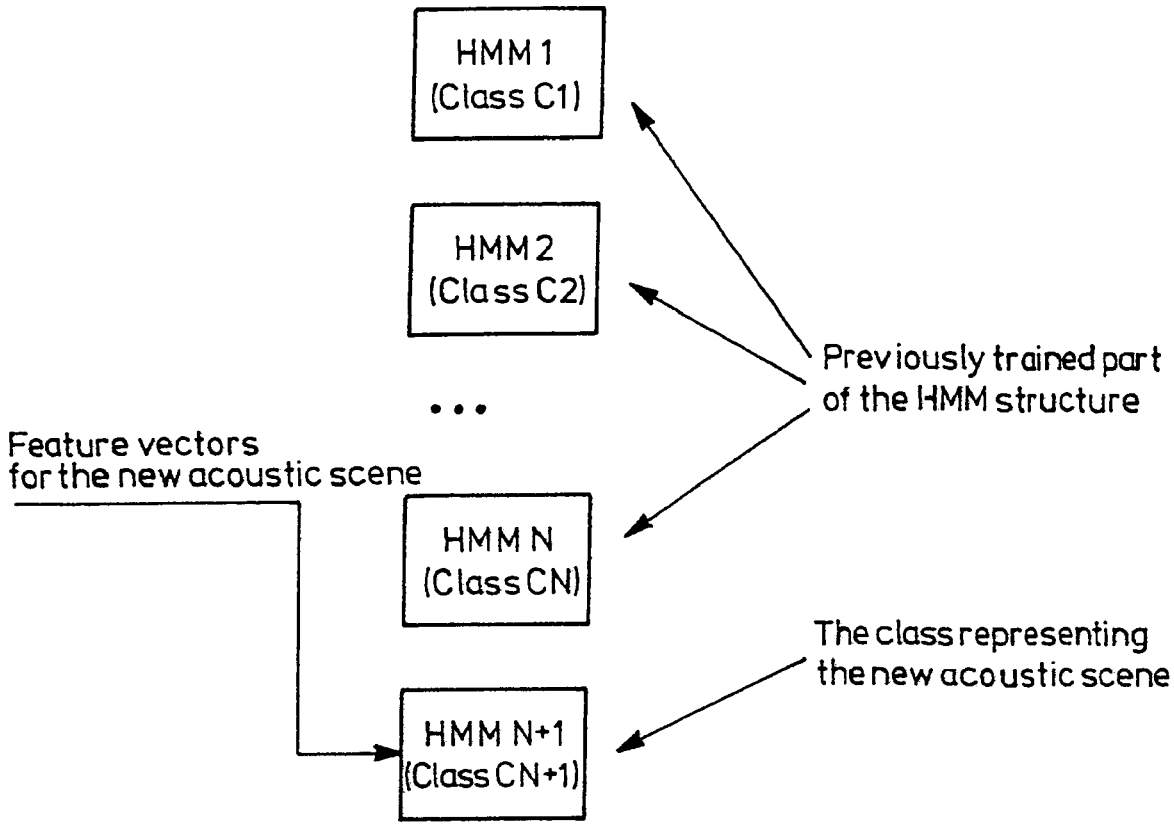
FIG. 3 a structure for the first embodiment of the present invention using HMM—(Hidden Markov Models)

FIG. 3 shows a HMM—(Hidden Markov Model) structure used as classifier to further illustrate the first example. Each class C1 to CN is represented by a corresponding HMM block HMM 1 to HMM N. The extension for the new scene is a HMM block HMM N+1 that represents the class CN+1 corresponding to the new acoustic scene.

EXAMPLE 2

A further method according to the present invention does not necessarily involve the hearing device user. It is assumed that the classifier has already been trained, but not with a large set of data. In other words, a so-called crude classifier determines the momentary acoustic scene. When a classifier is not trained well, it is hard for it to produce definite decisions if the real life data is temporally short, such as in rapidly changing acoustic scenes. However, if the real life data is long enough, the reliability of the classifier output gets higher. This second method utilizes this idea. In this case the training mode is turned on either by the user, e.g. via the switch unit 7 (FIG. 1), or automatically by the classifier itself. When the training mode is on, and the acoustic scene is steady (based on the crude classifiers decision over a certain time), the classifier trains itself further for this particular class (i.e. acoustic scene), which the crude classifier has already identified, updating its internal parameters on the fly, i.e. during regular operation of the hearing device. If the acoustic scene changes suddenly, the classifier turns off the training session for this acoustic scene. In a further embodiment, the hearing device user is involved in turning on and off the training mode. Therewith, the length of the training sessions can be controlled better.

Figure 4:
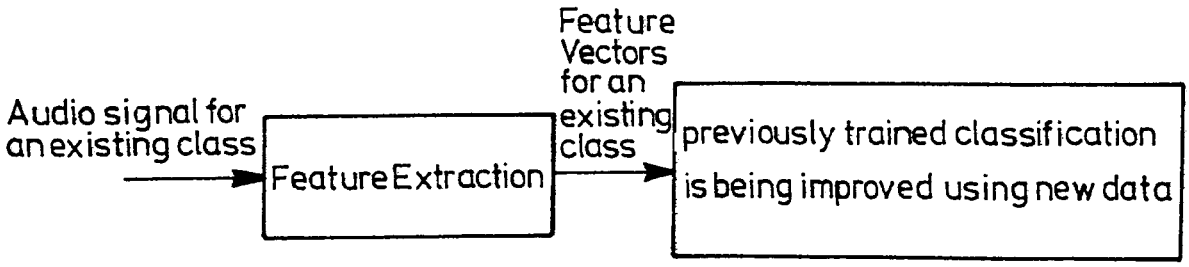
FIG. 4 a flow chart schematically illustrating basic steps of a second embodiment of the method according to the present invention.

The method is depicted in FIG. 4 schematically illustrating basic steps in a flow chart. The classifier is previously trained using a limited size data set, thus the classifier can only make crude decisions if the actual audio signal is short for an acoustic scene. When the hearing device is set to training mode (either by the user or automatically), the current acoustic scene's audio signal becomes the training audio signal. The hearing device trains its classifier for an existing class corresponding to the acoustic scene. It is pointed out that only existing classes are being trained. This example does not allow the training of the classifier for new classes.

EXAMPLE 3

A further embodiment of the method according to the present invention combines the example 1 and 2 as described above, in that the existing classes will be further trained, while new classes can be added to the classifier as new acoustic scenes are available.

EXAMPLE 4

A yet another embodiment of the method according to the present invention involves sound source separation. This is more of a training and classification of separate sound sources. For training, some involvement of the hearing device user is required for the separation of the sound source and for turning on the training mode. For separation of the sound source, instead of a sophisticated source separation algorithm or somehow marking a source, a narrow-beam forming can be used with the main beam directed towards the straight-ahead (0 degrees) direction, so that the source is separated as long as the hearing device user rotates his/her head to keep the source in straight-ahead direction. This will isolate the targeted source and as far as the training mode is on, the classifier will be trained for the targeted source. This will be quite useful, for instance, in speech sources. Speech recognition also can be incorporated into such a system.

Figure 5A:
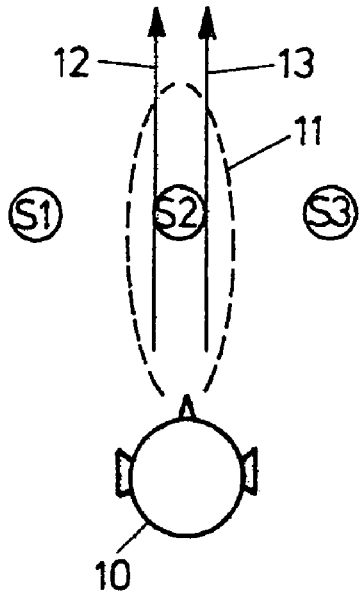
FIGS. 5A and 5B a hearing device user confronted with different sound sources in order to illustrate a third embodiment of the present invention.
Figure 5B:
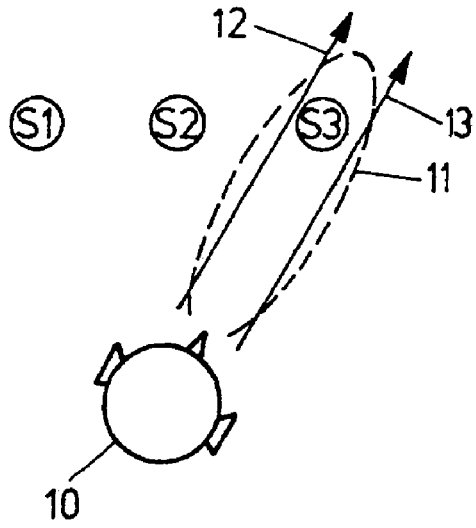

The method is depicted in FIGS. 5A and 5B. In FIG. 5A, a sound source S2 is separated from sound sources S1 and S3. Therewith, the classifier or the corresponding class, respectively, can be trained for the separated sound source S2, which is within a beam 11 of a beamformer. As it is shown in FIG. 5A, the head direction 12 of the hearing device user 10 is parallel to the beam direction 13. As a result thereof, the sound source S3 is separated when the hearing device user 10 turns his head towards the sound source S3. This situation is illustrated in FIG. 5B. The beam direction 13 and the head direction 12 always point in the same direction.

EXAMPLE 5

A further embodiment of the method according to the present invention is similar to example 4, that is, a sound source is separated and the classifier is trained for that sound source. However, in this embodiment, the sound source is tracked intelligently by the beamformer even if the hearing device user does not turn towards the sound source. This requires a somewhat more sophisticated sound source separation algorithm such that a sound source can be selected and tracked. In this embodiment, one possible input from the user might be the nature of the sound source that the training is to be done for. For instance, if speech is chosen, the sound source separation algorithm looks for a dominant speech source to track. A possible algorithm to perform this task has been described in EP-1 303 166, which corresponds to U.S. patent application with Ser. No. 10/172 333.

Figure 6A:
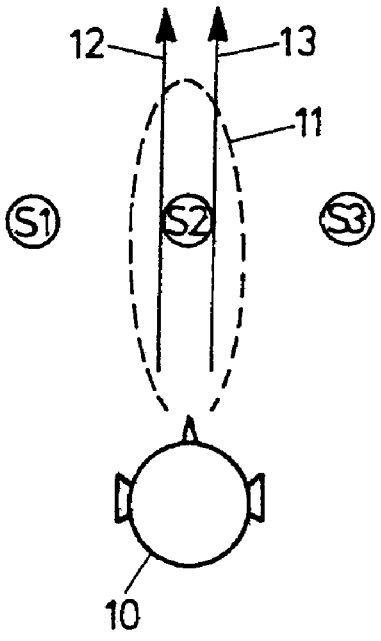
FIGS. 6*a* and 6B a hearing device user confronted with different sound sources in order to illustrate a fourth embodiment of the present invention.
Figure 6B:
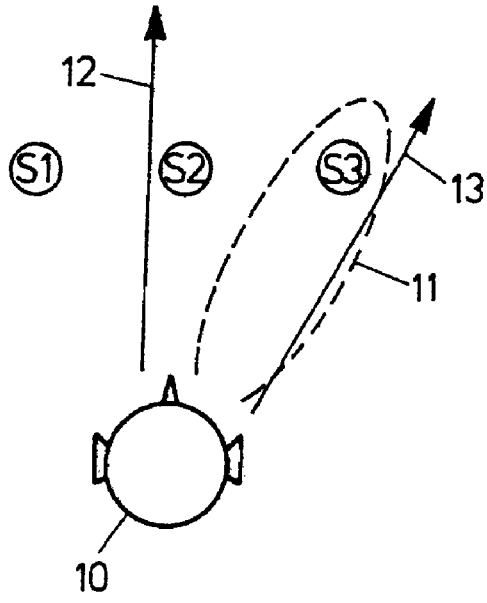

This embodiment of the present invention is further illustrated in FIGS. 6A and 6B. Even though the head direction 12 of the hearing device user 10 stays the same, the beam 11 is directed towards the active sound source S2 or S3, respectively, which is detected automatically by the hearing device.

EXAMPLE 6

A further embodiment of the method according to the present invention is an implementation of an alternative realisation of the automatic sound source tracking described in example 5. Here the sound source tracking is not done by a narrow beam of the beamformer, but by any other means, in particular by sound source marking and tracking means. These sound source marking and tracking means can include, for example, tracking an identification signal sent out by the source (e.g. an FM signal, an optical signal, etc.), or tracking a stimulus sent out by the hearing device itself and reflected by the source, as for example by providing a transponder unit in the vicinity of the corresponding sound source. These two possibilities have been described in connection to a key person communication system allowing the hearing device to identify the direction of a key person onto which the beam of the beamformer shall be directed, In this connection, reference is made to EP-1 303 166, which corresponds to U.S. patent application with Ser. No. 10/172 333.

The invention claimed is:

1. A method to adjust parameters of a transfer function of a hearing device, said method comprising the steps of:

extracting features of an input signal fed to the hearing device; classifying the extracted features into one of several possible classes;

selecting a class corresponding to a best estimate of a momentary acoustic scene during a regular operation of the hearing device;

adjusting at least some of the parameters of the transfer function in accordance with the selected class representing the best estimated momentary acoustic scene; and after said adjusting, training the hearing device to improve classification of the extracted feature or improve the best estimate of the momentary acoustic scene, respectively, during the regular operation of the hearing device, to provide another adjusting of at least some of the parameters of the transfer function in accordance with said improved classification or improved best estimate.

2. The method of claim 1, further comprising the step of adding a new class to the several possible classes based on said training.

3. The method of claim 1, further comprising the steps of:

separating a sound source from other sound sources; and only using the separated sound source for training the hearing device.

4. The method of claim 3, wherein a beam former is used for sound source separation.

5. The method of claim 3, further comprising the steps of:

marking the sound source being separated; and tracking the sound source being separated using the marking.

6. The method of claim 5, wherein one or several of the following markings are used for the tracking of the sound source being separated: an FM—(Frequency Modulated) signal, an optical signal, and a magnetic Signal.

7. A method to adjust parameters of a transfer function of a hearing device, said method comprising the steps of:

extracting features of an input signal fed to the hearing device;

classifying the extracted features into one of several possible classes;

selecting a class corresponding to a best estimate of a momentary acoustic scene during a regular operation of the hearing device;

adjusting at least some of the parameters of the transfer function in accordance with the selected class representing the best estimated momentary acoustic scene;

after said adjusting, surveying a control input to the hearing device;

activating a training phase as soon as the control input is being activated; and training the hearing device during the training phase by improving the best estimate of the momentary acoustic scene to provide another adjusting of at least some of the parameters of the transfer function in accordance with said improved best estimate wherein the hearing device is regularly operated during the training phase.

8. The method of claim 7, further comprising the step of terminating the training phase as soon as the control input is deactivated.

9. The method of claim 7, further comprising the step of terminating the training phase as soon as another acoustic scene is detected.

10. The method of claim 7, further comprising the step of automatically activating the control input after a new momentary scene has been detected for a preset interval.

11. The method of claim 7, further comprising the step of adding a new class to the several possible classes based on said training.

12. The method of claim 7, further comprising the steps of:

separating a sound source from other sound sources; and only using the separated sound source for training the hearing device.

13. The method of claim 12, wherein a beam former is used for sound source separation.

14. The method of claim 12, further comprising the steps of:

marking the sound source being separated; and tracking the sound source being separated using the marking.

15. The method of claim 14, wherein one or several of the following markings are used for the tracking of the sound source being separated: an FM—(Frequency Modulated) signal, optical signal, and a magnetic Signal.

16. A hearing device comprising:

at least one microphone to generate at least one input signal;

a main processing unit to which the at least one input signal is fed;

a receiver operationally connected to the main processing unit;

means for extracting features of the at least one input signal;

means for classifying the extracted features into one of several possible classes;

means for selecting a class corresponding to a best estimate of a momentary acoustic scene during regular operation;

means for adjusting at least some of the parameters of a transfer function between the at least one microphone and the receiver in accordance with the best estimated momentary acoustic scene; and training means to improve the best estimate of the momentary acoustic scene during the regular operation.

17. The device of claim 16, further comprising separating means to separate a sound source from other sound sources.

18. The device of claim 17, wherein a beam former is used as separating means.

19. The device of claim 17, further comprising:

marking means for marking the sound source being separated; and tracking means for tracking the sound source being separated using the marking means.

20. The device of claim 19, wherein one or several of the following marking means are used: an FM—(Frequency Modulated) signal, an optical signal, and a magnetic Signal.

21. A hearing device comprising:

at least one microphone to generate at least one input signal;

a main processing unit to which the at least one input signal is fed;

a receiver operationally connected to the main processing unit;

means for extracting features of the at least one input signal;

means for classifying the extracted features into one of several possible classes;

means for selecting a class corresponding to a best estimate of a momentary acoustic scene;

means for adjusting at least some of the parameters of a transfer function between the at least one microphone and the receiver in accordance with the best estimated momentary acoustic scene;

means for surveying a control input;

means for activating a training phase as soon as the control input is being activated; and training means for training the hearing device during a training phase by improving the best estimate of the momentary acoustic scene, wherein the main processing unit and the training means are operated simultaneously.

22. The device of claim 21, wherein the training means are deactivateable.

23. The device of claim 21, further comprising separating means to separate a sound source from other sound sources.

24. The device of claim 23, wherein a beam former is used as separating means.

25. The device of claim 23, further comprising:

marking means for marking the sound source being separated; and tracking means for tracking the sound source being separated using the marking means.

26. The device of claim 25, wherein one or several of the following marking means are used: an FM—(Frequency Modulated) signal, an optical signal, and a magnetic Signal.

* * * * *

UNITED STATES PATENT AND TRADEMARK OFFICE

CERTIFICATE OF CORRECTION

PATENT NO. : 7,319,769 B2
APPLICATION NO. : 11/008440
DATED : January 15, 2008
INVENTOR(S) : Silvia Allegro-Baumann et al.

It is certified that error appears in the above-identified patent and that said Letters Patent is hereby corrected as shown below:

Title page, Item 54 and Col. 1, Line 1-3, Delete -- METHOD TO ADJUST PARAMETERS OF A TRANSFER FUNCTION OF A HEARING DEVICE AS WELL AS HEARING DEVICE --
and insert therefor-- METHOD TO ADJUST PARAMETERS OF A TRANSFER FUNCTION OF A HEARING DEVICE AS WELL AS A HEARING DEVICE --

Signed and Sealed this

Third Day of June, 2008

JON W. DUDAS
*Director of the United States Patent and Trademark Office*